US006662155B2

(12) United States Patent
Rotola-Pukkila et al.

(10) Patent No.: US 6,662,155 B2
(45) Date of Patent: Dec. 9, 2003

(54) METHOD AND SYSTEM FOR COMFORT NOISE GENERATION IN SPEECH COMMUNICATION

(75) Inventors: Jani Rotola-Pukkila, Tampere (FI); Hannu Mikkola, Tampere (FI); Janne Vainio, Lempäälä (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/970,091

(22) Filed: Oct. 2, 2001

(65) Prior Publication Data

US 2002/0103643 A1 Aug. 1, 2002

Related U.S. Application Data

(60) Provisional application No. 60/253,170, filed on Nov. 12, 2000.

(51) Int. Cl.[7] ..... G10L 21/02; G10L 11/06

(52) U.S. Cl. ..... 704/228; 704/210; 704/226; 704/227; 704/233

(58) Field of Search ..... 714/39, 758; 704/277, 704/236, 233, 230, 229, 228, 226, 225, 220, 219, 216, 210, 205, 200.1; 379/406.3

(56) References Cited

U.S. PATENT DOCUMENTS

| | | | | | |
|---|---|---|---|---|---|
| 5,579,435 | A | * | 11/1996 | Jansson | 704/233 |
| 5,812,965 | A | * | 9/1998 | Massaloux | 704/205 |
| 5,960,389 | A | * | 9/1999 | Jarvinen et al. | 704/220 |
| 5,991,718 | A | * | 11/1999 | Malah | 704/233 |
| 6,035,179 | A | * | 3/2000 | Virtanen | 455/63 |

FOREIGN PATENT DOCUMENTS

| | | | |
|---|---|---|---|
| DE | 19941331 | 3/2000 | H04L/12/26 |
| WO | WO 0011648 | 3/2000 | G10L/19/00 |
| WO | WO 0011649 | 3/2000 | G10L/19/00 |
| WO | WO 0031719 | 6/2000 | |

OTHER PUBLICATIONS

"Immitance Spectral Pairs (ISP) for Speech Encoding" —Y. Bistritz et al., Department of Electrical Engineering, Tel Aviv University; IEEE, 4/93.

ETSI EN 300 728 V8.0.1 (2000–11) Digital cellular telecommunicatons system (Phase 2+); Comfort noise aspects for Enhanced Full Rate (EFR) speech traffic channels.

3GPP TS 26.192 V5.0.0 (2001–03) 3rd Generation Partnership Project; Technical Specification Group Services and System Aspects; Speech Codec speech processing functions; AMR Wideband Speech Codec; Comfort noise aspects (Release 5).

TDMA Cellular/PCS—Radio Interface Enhanced Full–Rate Voice Codec Revision A (TIA/EIA IS–641–A).

* cited by examiner

*Primary Examiner*—Vijay Chawan
*Assistant Examiner*—V. Paul Harper
(74) *Attorney, Agent, or Firm*—Ware, Fressola, Van Der Sluys & Adolphson LLP; Bradford Green

(57) ABSTRACT

A method and system for providing comfort noise in the non-speech periods in speech communication. The comfort noise is generated based on whether the background noise in the speech input is stationary or non-stationary. If the background noise is non-stationary, a random component is inserted in the comfort noise using a dithering process. If the background noise is stationary, the dithering process is not used.

25 Claims, 7 Drawing Sheets

METHOD AND SYSTEM FOR COMFORT NOISE GENERATION IN SPEECH COMMUNICATION

This application claims the benefit of Provisional Application No. 60/253,170, filed Nov. 27, 2000.

FIELD OF THE INVENTION

The present invention relates generally to speech communication and, more particularly, to comfort noise generation in discontinuous transmission.

BACKGROUND OF THE INVENTION

In a normal telephone conversation, one user speaks at a time and the other listens. At times, neither of the users speak. The silent periods could result in a situation where average speech activity is below 50%. In these silent periods, only acoustic noise from the background is likely to be heard. The background noise does not usually have any informative content and it is not necessary to transmit the exact background noise from the transmit side (TX) to the receive side (RX). In mobile communication, a procedure known as discontinuous transmission (DTX) takes advantage of this fact to save power in the mobile equipment. In particular, the TX DTX mechanism has a low state (DTX Low) in which the radio transmission from the mobile station (MS) to the base station (BS) is switched off most of the time during speech pauses to save power in the MS and to reduce the overall interference level in the air interface.

A basic problem when using DTX is that the background acoustic noise, present with the speech during speech periods, would disappear when the radio transmission is switched off, resulting in discontinuities of the background noise. Since the DTX switching can take place rapidly, it has been found that this effect can be very annoying for the listener. Furthermore, if the voice activity detector (VAD) occasionally classifies the noise as speech, some parts of the background noise are reconstructed during speech synthesis, while other parts remain silent. Not only is the sudden appearance and disappearance of the background noise very disturbing and annoying, it also decreases the intelligibility of the conversation, especially when the energy level of the noise is high, as it is inside a moving vehicle. In order to reduce this disturbing effect, a synthetic noise similar to the background noise on the transmit side is generated on the receive side. The synthetic noise is called comfort noise (CN) because it makes listening more comfortable.

In order for the receive side to simulate the background noise on the transmit side, the comfort noise parameters are estimated on the transmit side and transmitted to the receive side using Silence Descriptor (SID) frames. The transmission takes place before transitioning to the DTX Low state and at an MS defined rate afterwards. The TX DTX handler decides what kind of parameters to compute and whether to generate a speech frame or a SID frame. FIG. 1 describes the logical operation of TX DTX. This operation is carried out with the help of a voice activity detector (VAD), which indicates whether or not the current frame contains speech. The output of the VAD algorithm is a Boolean flag marked with 'true' if speech is detected, and 'false' otherwise. The TX DTX also contains the speech encoder and comfort noise generation modules.

The basic operation of the TX DTX handler is as follows. A Boolean speech (SP) flag indicates whether the frame is a speech frame or a SID frame. During a speech period, the SP flag is set 'true' and a speech frame is generated using the speech coding algorithm. If the speech period has been sustained for a sufficiently long period of time before the VAD flag changes to 'false', there exists a hangover period (see FIG. 2). This time period is used for the computation of the average background noise parameters. During the hangover period, normal speech frames are transmitted to the receive side, although the coded signal contains only background noise. The value of SP flag remains 'true' in the hangover period. After the hangover period, the comfort noise (CN) period starts. During the CN period, the SP flag is marked with 'false' and the SID frames are generated.

During the hangover period, the spectrum, S, and power level, E, of each frame is saved. After the hangover, the averages of the saved parameters, $S_{ave}$ and $E_{ave}$, are computed. The averaging length is one frame longer than the length of the hangover period. Therefore, the first comfort noise parameters are the averages from the hangover period and the first frame after it.

During the comfort noise period, SID frames are generated every frame, but they are not all sent. The TX radio subsystem (RSS) controls the scheduling of the SID frame transmission based on the SP flag. When a speech period ends, the transmission is cut off after the first SID frame. Afterward, one SID frame is occasionally transmitted in order to update the estimation of the comfort noise.

FIG. 3 describes the logical operation of the RX DTX. If errors have been detected in the received frame, the bad frame indication (BFI) flag is set 'true'. Similar to the SP flag in the transmit side, a SID flag in the receive side is used to describe whether the received frame is a SID frame or a speech frame.

The RX DTX handler is responsible for the overall RX DTX operation. It classifies whether the received frame is a valid frame or an invalid frame (BFI=0 or BFI=1, respectively) and whether the received frame is a SID frame or a speech frame (SID=1 or SID=0, respectively). When a valid speech frame is received, the RX DTX handler passes it directly to the speech decoder. When an erroneous speech frame is received or the frame is lost during a speech period, the speech decoder uses the speech related parameters from the latest good speech frame for speech synthesis and, at the same time, the decoder starts to gradually mute the output signal.

When a valid SID frame is received, comfort noise is generated until a new valid SID frame is received. The process repeats itself in the same manner. However, if the received frame is classified as an invalid SID frame, the last valid SID is used. During the comfort noise period, the decoder receives transmission channel noise between SID frames that have never been sent. To synthesize signals for those frames, comfort noise is generated with the parameters interpolated from the two previously received valid SID frames for comfort noise updating. The RX DTX handler ignores the unsent frames during the CN period because it is presumably due to a transmission break.

Comfort noise is generated using analyzed information from the background noise. The background noise can have very different characteristics depending on its source. Therefore, there is no general way to find a set of parameters that would adequately describe the characteristics of all types of background noise, and could also be transmitted just a few times per second using a small number of bits. Because speech synthesis in speech communication is based on the human speech generation system, the speech synthesis algorithms cannot be used for the comfort noise generation in the same way. Furthermore, unlike speech related parameters, the parameters in the SID frames are not transmitted every frame. It is known that the human auditory system concentrates more on the amplitude spectrum of the signal than to the phase response. Accordingly, it is sufficient to transmit only information about the average spectrum and power of the background noise for comfort noise generation. Comfort noise is, therefore, generated using these two parameters. While this type of comfort noise generation actually introduces much distortion in the time domain, it resembles the background noise in the frequency domain. This is enough to reduce the annoying effects in the transition interval between a speech period and a comfort noise period. Comfort noise generation that works well has a very soothing effect and the comfort noise does not draw attention to itself. Because the comfort noise generation decreases the transmission rate while introducing only small perceptual error, the concept is well accepted. However, when the characteristics of the generated comfort noise differ significantly from the true background noise, the transition between comfort noise and true background noise is usually audible.

In prior art, synthesis Linear Predictive (LP) filter and energy factors are obtained by interpolating parameters between the two latest SID frames (see FIG. 4). This interpolation is performed on a frame-by-frame basis. Inside a frame, the comfort noise codebook gains of each subframe are the same. The comfort noise parameters are interpolated from the received parameters at the transmission rate of the SID frames. The SID frames are transmitted at every $k^{th}$ frame. The SID frame transmitted after the $n^{th}$ frame is the $(n+k)^{th}$ frame. The CN parameters are interpolated in every frame so that the interpolated parameters change from those of the $n^{th}$ SID frame to those of the $(n+k)^{th}$ SID frame when the latter frame is received. The interpolation is performed as follows:

$$S'(n+i) = S(n)*\frac{i}{k} + S(n-k)*\left(1-\frac{i}{k}\right), \tag{1}$$

where k is the interpolation period, S'(n+i) is the spectral parameter vector of the $(n+i)^{th}$ frame, i=0, . . . , k−1, S(n) is the spectral parameter vector of the latest updating and S(n−k) is the spectral parameter vector of the second latest updating. Likewise, the received energy is interpolated as follows:

$$E'(n+i) = E(n)*\frac{i}{k} + E(n-k)*\left(1-\frac{i}{k}\right), \tag{2}$$

where k is the interpolation period, E'(n+i) is the received energy of the $(n+i)^{th}$ frame, i=0, . . . , k−1, E(n) is the received energy of the latest updating and E(n−k) is the received energy of the second latest updating. In this manner, the comfort noise is varying slowly and smoothly, drifting from one set of parameters toward another set of parameters. A block diagram of this prior-art solution is shown in FIG. 4. GSM EFR (Global System for Mobile Communication Enhanced Full Rate) codec uses this approach by transmitting synthesis (LP) filter coefficients in LSF domain. Fixed codebook gain is used to transmit the energy of the frame. These two parameters are interpolated according to Eq. 1 and Eq.2 with k=24. A detailed description of the GSM EFR CN generation can be found from Digital Cellular Telecommunications system (Phase 2+), Comfort Noise Aspects for Enhanced Full Rate Speech Traffic Channels (ETSI EN 300 728 v8.0.0 (2000-07)).

Alternatively, energy dithering and spectral dithering blocks are used to insert a random component into those parameters, respectively. The goal is to simulate the fluctuation in spectrum and energy level of the actual background noise. The operation of the spectral dithering block is as follows (see FIG. 5):

$$S_{ave}''(i)=S_{ave}'(i)+rand(-L,L),\ i=0,\ldots,M-1, \tag{3}$$

where S is in this case an LSF vector, L is a constant value, rand(−L,L) is random function generating values between −L and L, $S_{ave}''(i)$ is the LSF vector used for comfort noise spectral representation, $S_{ave}'(i)$ is the averaged spectral information (LSF domain) of background noise and M is the order of synthesis filter (LP). Likewise, energy dithering can be carried as follows:

$$E_{ave}''(i)=E_{ave}'(i)+rand(-L,L),\ i=0,\ldots,M-1 \tag{4}$$

The energy dithering and spectral (LP) dithering blocks perform dithering with a constant magnitude in prior art solutions. It should be noted that synthesis (LP) filter coefficients are also represented in LSF domain in the description of this second prior art system. However, any other representation may also be used (e.g. ISP domain).

Some prior-art systems, such as IS-641, discards the energy dithering block in comfort noise generation. A detailed description of the IS-461 comfort noise generation can be found in TDMA Cellular/PCS-Radio Interface Enhanced Full-Rate Voice Codec, Revision A (TIA/EIA IS-641-A).

The above-described prior art solutions work reasonably well with some background noise types, but poorly with other noise types. For stationary background noise types (like car noise or wind as background noise), the non-dithering approach performs well, whereas the dithering approach does not perform as well. This is because the dithering approach introduces random jitters into the spectral parameter vectors for comfort noise generation, although the background noise is actually stationary. For non-stationary background noise types (street or office noise), the dithering approach performs reasonably well, but not the non-dithering approach. Thus, the dithering approach is more suitable for simulating non-stationary characteristics of the background noise, while the non-dithering approach is more suitable for generating stationary comfort noise for cases where the background noise fluctuates in time. Using either approach to generate comfort noise, the transition between the synthesized background noise and the true background noise, in many occasions, is audible.

It is advantageous and desirable to provide a method and system for generating comfort noise, wherein the audibility in the transition between the synthesized background noise and the true background noise can be reduced or substantially eliminated, regardless of whether the true background noise is stationary or non-stationary. WO0031719 describes a method for computing variability information to be used for modification of the comfort noise parameters. In particular, the calculation of the variability information is carried out in the decoder. The computation can be performed totally in the decoder where, during the comfort noise period, variability information exists only about one comfort noise frame (every $24^{th}$ frame) and the delay due to the computation will be long. The computation can also be divided between the encoder and the decoder, but a higher bit-rate is required in the transmission channel for sending information from the encoder to the decoder. It is advantageous to provide a simpler method for modifying the comfort noise.

SUMMARY OF THE INVENTION

It is a primary object of the present invention to reduce or substantially eliminate the audibility in the transition between the true background noise in the speech periods and the comfort noise provided in the non-speech period. This object can be achieved by providing comfort noise based upon the characteristics of the background noise.

Accordingly, the first aspect of the present invention is a method of generating comfort noise in non-speech periods in speech communication, wherein signals indicative of a speech input are provided in frames from a transmit side to a receive side for facilitating said speech communication, wherein the speech input has a speech component and a non-speech component, the non-speech component classifiable as stationary and non-stationary. The method comprises the steps of:

determining whether the non-speech component is stationary or non-stationary;

providing in the transmit side a further signal having a first value indicative of the non-speech component being stationary or a second value indicative of the non-speech component being non-stationary; and providing in the receive side the comfort noise in the non-speech periods, responsive to the further signal received from the transmit side, in a manner based on whether the further signal has the first value or the second value.

According to the present invention, the signals include a spectral parameter vector and an energy level estimated from the non-speech component of the speech input, and the comfort noise is generated based on the spectral parameter vector and the energy level. If the further signal has the second value, a random value is inserted into elements of the spectral parameter vector and the energy level for generating the comfort noise.

According to the present invention, the determining step is carried out based on spectral distances among the spectral parameter vectors. Preferably, the spectral distances are summed over an averaging period for providing a summed value, and wherein the non-speech component is classified as stationary if the summed value is smaller than a predetermined value and the non-speech component is classified as non-stationary if the summed value is larger or equal to the predetermined value. The spectral parameter vectors can be linear spectral frequency (LSF) vectors, immittance spectral frequency (ISF) vectors and the like.

According to the second aspect of the present invention, a system for generating comfort noise in speech communication in a communication network having a transmit side for providing speech related parameters indicative of a speech input, and a receive side for reconstructing the speech input based on the speech related parameters, wherein the speech communication has speech periods and non-speech periods and the speech input has a speech component and a non-speech component, the non-speech component classifiable as stationary and non-stationary, and wherein the comfort noise is provided in the non-speech periods. The system comprises:

means, located on the transmit side, for determining whether the non-speech component is stationary or non-stationary for providing a signal having a first value indicative of the non-speech component being stationary or a second value indicative of the non-speech component being non-stationary;

means, located on the receive side, responsive to the signal, for inserting a random component in the comfort noise only if the signal has the second value.

According to the third aspect of the present invention, a speech coder for use in speech communication having an encoder for providing speech parameters indicative of a speech input, and a decoder, responsive to the provided speech parameters, for reconstructing the speech input based on the speech parameters, wherein the speech communication has speech periods and non-speech periods and the speech input has a speech component and a non-speech component, the non-speech component classifiable as stationary or non-stationary, and wherein the encoder comprises a spectral analysis module, responsive to the speech input, for providing a spectral parameter vector and energy parameter indicative of the non-speech component of the speech input, and the decoder comprises means for providing a comfort noise in the non-speech periods to replace the non-speech component based on the spectral parameter vector and energy parameter. The speech coder comprises:

a noise detector module, located in the encoder, responsive to the spectral parameter vector and energy parameter, for determining whether the non-speech component is stationary or non-stationary and providing a signal having a first value indicative of the non-speech component being stationary and a second value indicative of the non-speech component being non-stationary; and a dithering module, located in the decoder, responsive to the signal, for inserting a random component in elements of the spectral parameter vector and energy parameter for modifying the comfort noise only if the non-speech component is non-stationary.

The present invention will become apparent upon reading the description taking in conjunction with FIGS. 1 to 7.

DETAILED DESCRIPTION OF THE INVENTION

Figure 6:
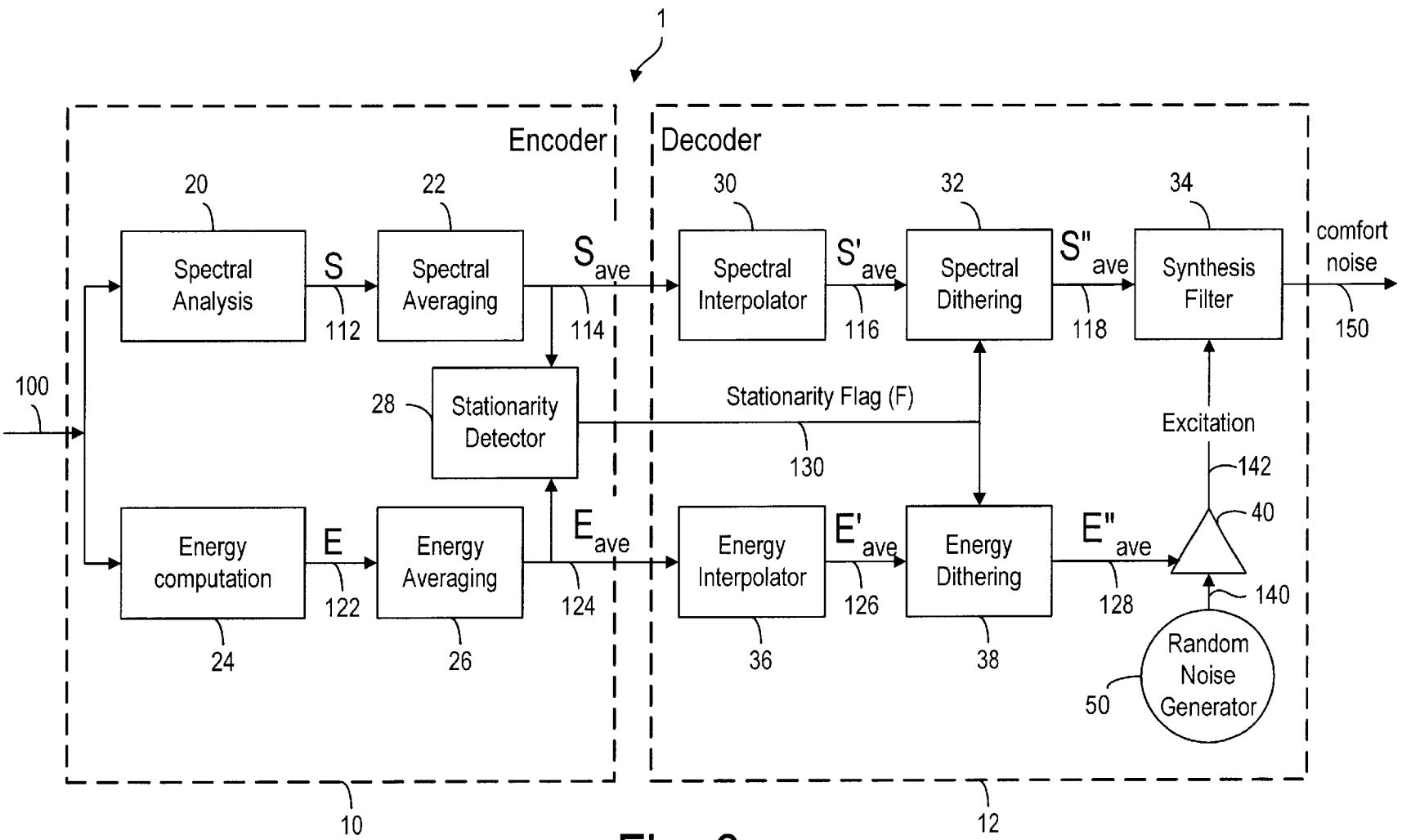
FIG. 6 is a block diagram showing the comfort noise generation system, according to the present invention.

The comfort noise generation system 1, according to the present invention, is shown in FIG. 6. As shown, the system 1 comprises an encoder 10 and a decoder 12. In the encoder 10, a spectral analysis module 20 is used to extract linear prediction (LP) parameters 112 from the input speech signal 100. At the same time, an energy computation module 24 is used to compute the energy factor 122 from the input speech signal 100. A spectral averaging module 22 computes the average spectral parameter vectors 114 from the LP parameters 112. Likewise, an energy averaging module 26 computes the received energy 124 from the energy factor 122.

The computation of averaged parameters is known in the art, as disclosed in Digital Cellular Telecommunications system (Phase 2+), Comfort Noise Aspects for Enhanced Full Rate Speech Traffic Channels (ETSI EN 300 728 v8.0.0 (2000-07)). The average spectral parameter vectors 114 and the average received energy 124 are sent from the encoder 10 on the transmit side to the decoder 12 on the receive side, as in the prior art.

Figure 1:
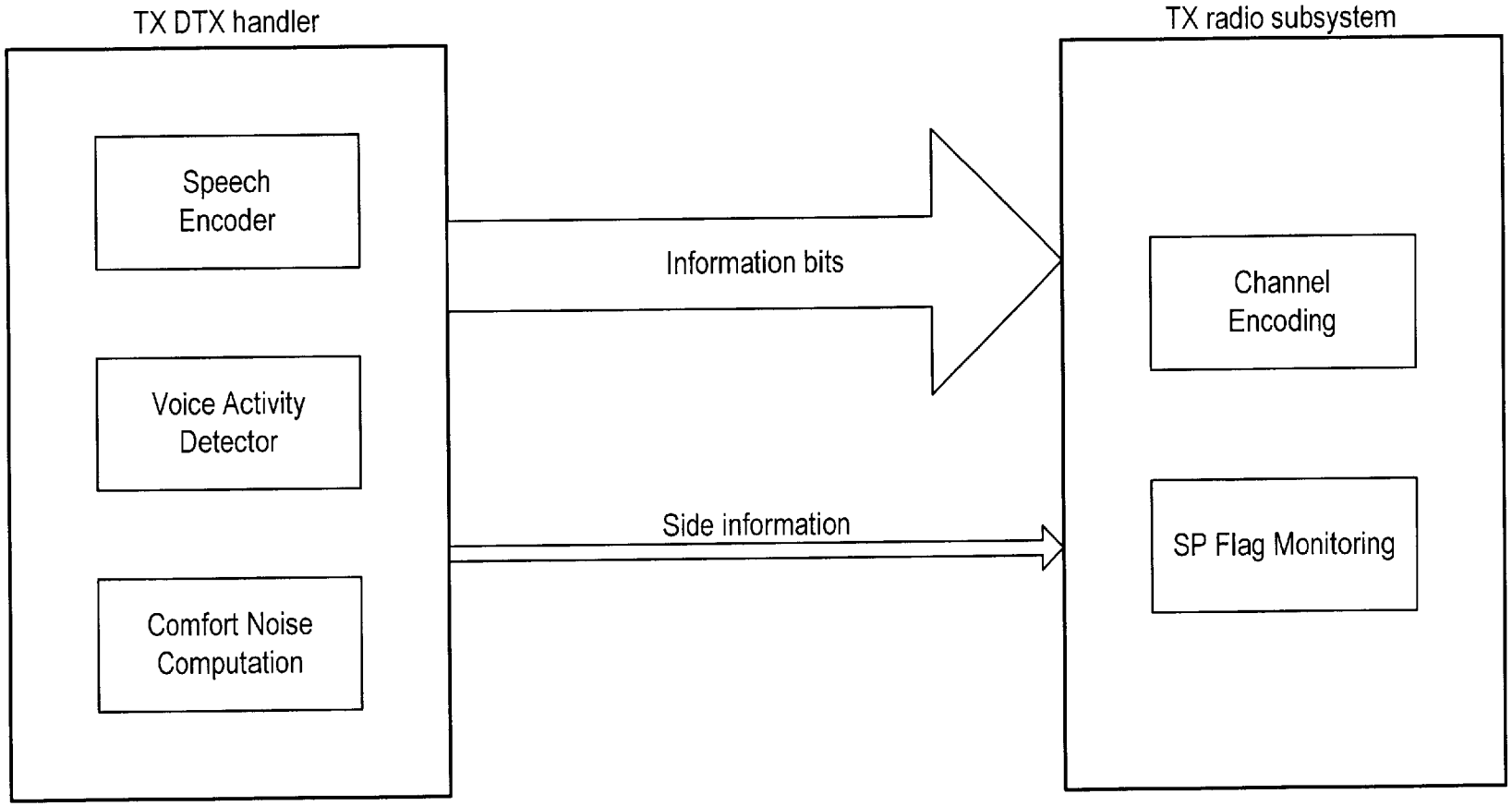
FIG. 1 is a block diagram showing a typical transmit-side discontinuous transmission handler.
Figure 2:
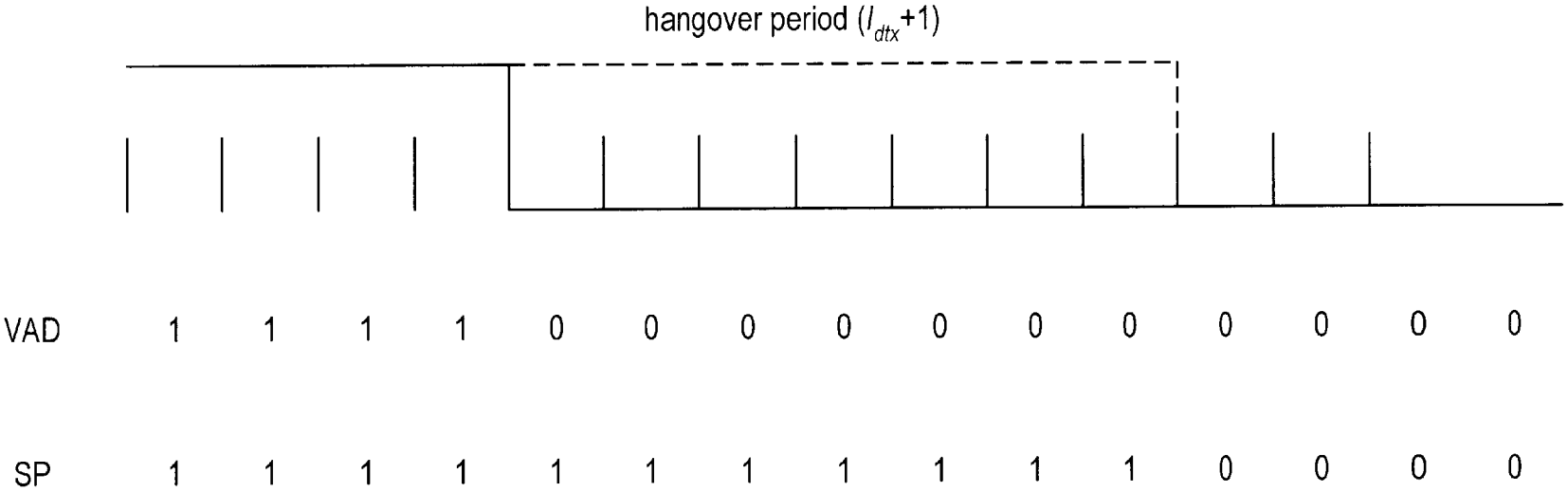
FIG. 2 is a timing diagram showing the synchronization between a voice activity detector and a Boolean speech flag.
Figure 3:
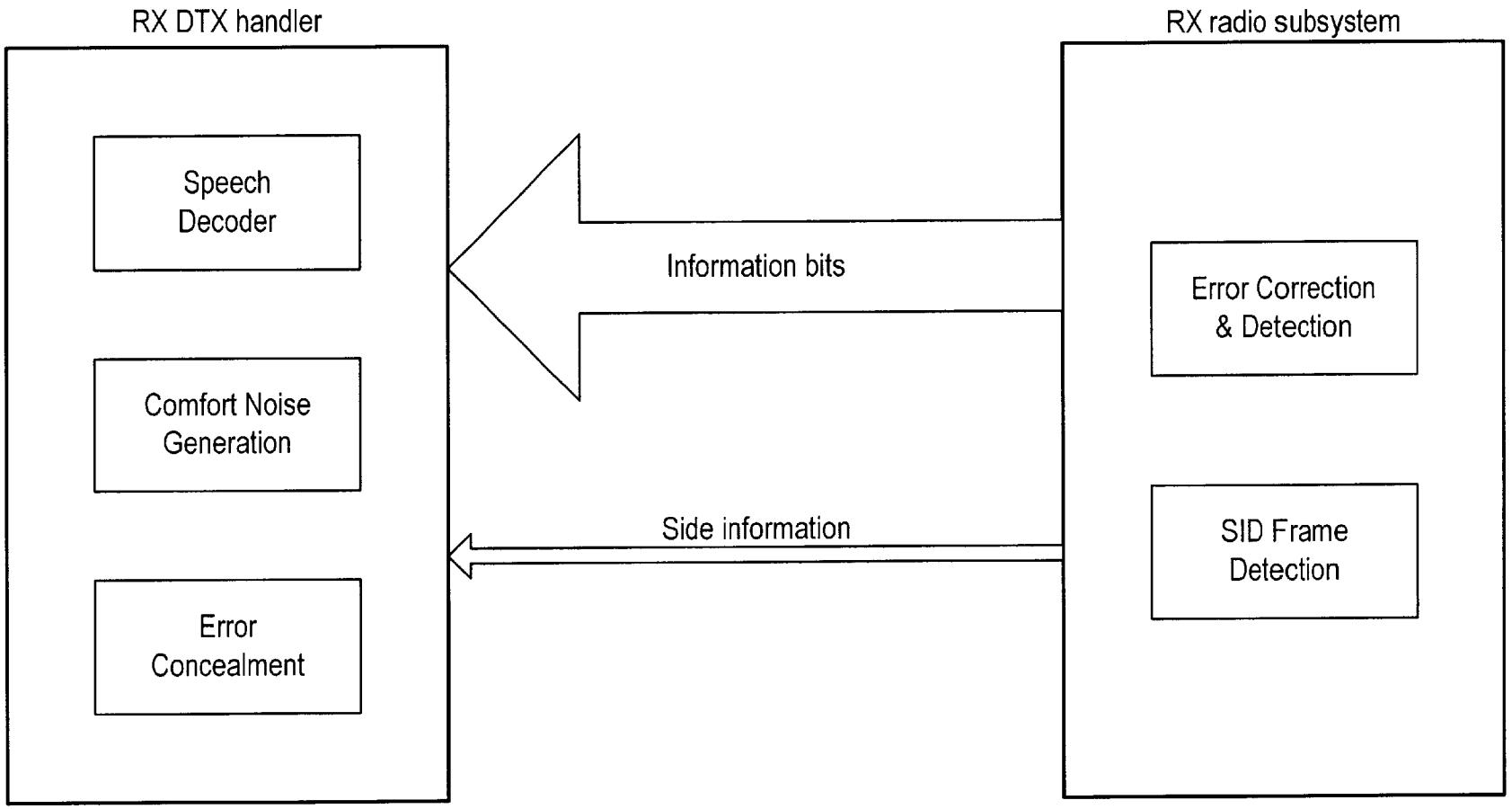
FIG. 3 is a block diagram showing a typical receive-side discontinuous transmission handler.
Figure 4:
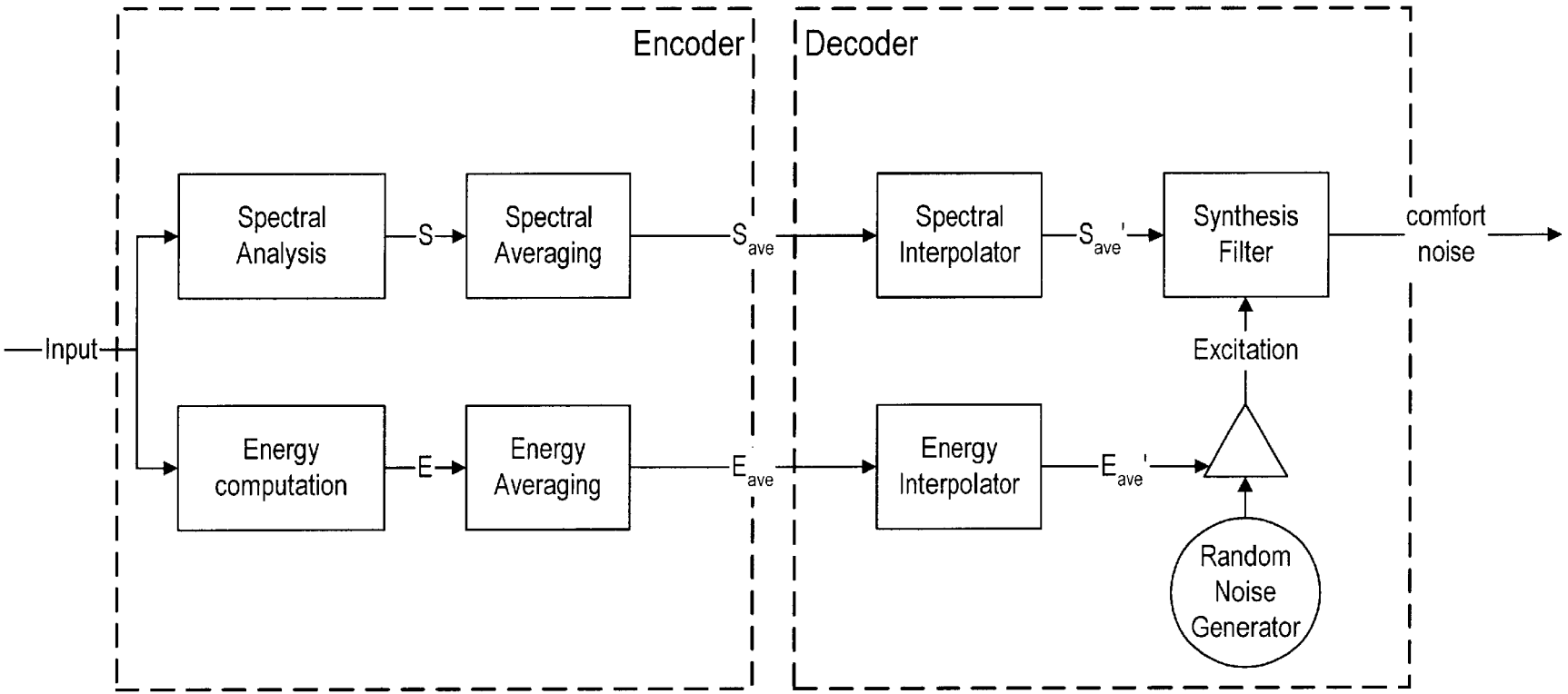
FIG. 4 is a block diagram showing a prior art comfort noise generation system using the non-dithering approach.
Figure 5:
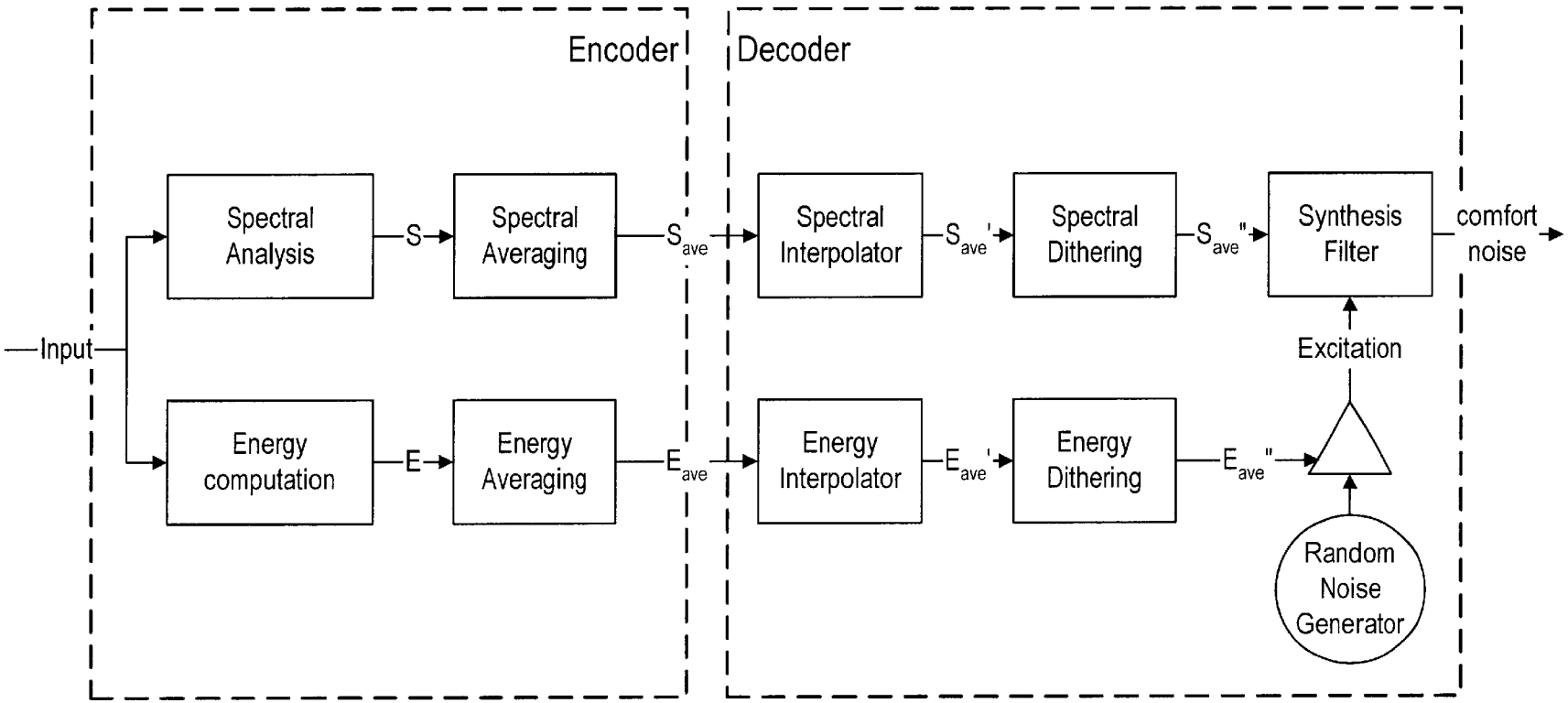
FIG. 5 is a block diagram showing a prior art comfort noise generation system using the dithering approach.

In the encoder 10, according to the present invention, a detector module 28 determines whether the background noise is stationary or non-stationary from the spectral parameter vectors 114 and the received energy 124. The information indicating whether the background noise is stationary or non-stationary is sent from the encoder 10 to the decoder 12 in the form of a "stationarity-flag" 130. The flag 130 can be sent in a binary digit. For example, when the background noise is classified as stationary, the stationarity-flag is set and the flag 130 is given a value of 1. Otherwise, the stationarity-flag is NOT set and the flag 130 is given a value of 0. Like the prior art decoder, as shown in FIGS. 4 and 5, a spectral interpolator 30 and an energy interpolator 36 interpolate S'(n+i) and E'(n+i) in a new SID frame from previous SID frames according to Eq.1 and Eq.2, respectively. The interpolated spectral parameter vector, $S'_{ave}$, is denoted by reference numeral 116. The interpolated received energy, $E'_{ave}$, is denoted by reference numeral 126. If the background noise is classified by the detector module 28 as non-stationary, as indicated by the value of flag 130 (=0), a spectral dithering module 32 simulates the fluctuation of the actual background noise spectrum by inserting a random component into the spectral parameter vectors 116, according to Eq.3, and an energy dithering module 38 inserts random dithering into the received energy 126, according to Eq.4. The dithered spectral parameter vector, $S''_{ave}$, is denoted by reference numeral 118, the dithered received energy $E''_{ave}$, is denoted by reference numeral 128. However, if the background noise is classified as stationary, the stationarity-flag 130 is set. The spectral dithering module 32 and the energy dithering module 38 are effectively bypassed so that $S''_{ave}=S'_{ave}$, and $E''_{ave}=E'_{ave}$. In that case, the signal 118 is identical to the signal 116, and the signal 128 is identical to the signal 126. In either case, the signal 128 is conveyed to a scaling module 40. Based on the average energy $E''_{ave}$, the scaling module 40 modifies the energy of the comfort noise so that the energy level of the comfort noise 150, as provided by the decoder 12, is approximately equal to the energy of the background noise in the encoder 10. As shown in FIG. 6, a random noise generator 50 is used to generate a random white noise vector to be used as an excitation. The white noise is denoted by reference numeral 140 and the scaled or modified white noise is denoted by reference numeral 142. The signal 118, or the average spectral parameter vector $S''_{ave}$, representing the average background noise of the input 100, is provided to a synthesis filter module 34. Based on the signal 118 and the scaled excitation 142, the synthesis filter module 34 provides the comfort noise 150.

The background noise can be classified as stationary or non-stationary based on the spectral distances $\Delta D_i$ from each of the spectral parameter (LSF or ISF) vectors f(i) to the other spectral parameter vectors f(j), i=0, . . . , $l_{dtx}-1$, j=0, . . . , $l_{dtx}-1$, i≠j within the CN averaging period ($l_{dtx}$). The averaging period is typically 8. The spectral distances are approximated as follows:

$$\Delta D_i = \sum_{j=0, j\neq i}^{l_{DTX}-1} \Delta R_{ij}, \tag{5}$$

or all i=0, . . . , $l_{dtx}-1$, i≠j, where $$\Delta R_{ij} = \sum_{k=1}^{M} (f_i(k) - f_j(k))^2, \tag{6}$$

and $F_i(k)$ is the kth spectral parameter of the spectral parameter vector f(i) at frame i, and M is the order of synthesis filter (LP).

If the averaging period is 8, then the total spectral distance is $$D_s = \sum_{i=0}^{7} \Delta D_i.$$

If $D_s$ is small, the stationarity-flag is set (the flag 130 has a value of 1), indicating that the background noise is stationary. Otherwise, the stationarity-flag is NOT set (the flag 130 has a value of 0), indicating that the background noise is non-stationary. Preferably, the total spectral distance $D_s$ is compared against a constant, which can be equal to 67108864 in fixed-point arithmetic and about 5147609 in floating point. The stationarity-flag is set or NOT set depending on whether or not $D_s$ is smaller than that constant.

Additionally, the power change between frames may be taken into consideration. For that purpose, the energy ratio between two consecutive frames E(i)/E(i+1) is computed. As it is known in the art, the frame energy for each frame marked with VAD=0 is computed as follows:

$$\begin{aligned} en_{\log}(i) &= \frac{1}{2}\log_2\left(\frac{1}{N}\sum_{n=0}^{N-1} s^2(n)\right) \\ &= \log_2 E(i) \end{aligned} \tag{7}$$

where s(n) is the high-pass-filtered input speech signal of the current frame i. If more than one of these energy ratios is large enough, the stationarity-flag is reset (the value of flag 130 becomes 0), even if it has been set earlier for $D_s$ being small. This is equivalent to comparing the frame energy in the logarithmic domain for each frame with the averaged logarithmic energy. Thus, if the sum of absolute deviation of $en_{log}(i)$ from the average $en_{log}$ is large, the stationarity-flag is reset even if it has been set earlier for $D_s$ being small. If the sum of absolute deviation is larger than 180 in fixed-point arithmetic (1.406 in floating point), the stationarity-flag is reset When inserting dithering into spectral parameter vectors, according to Eq.3, it is preferred that a smaller amount of dithering be inserted into lower spectral components than the amount of dithering inserted into the higher spectral components (LSF or ISF elements). This modifies the insertion of spectral dithering Eq.3 into the following form:

$$S_{ave}''(i)=S_{ave}'(i)+rand\,(-L(i),L(i)),\ i=0, \ldots, M-1 \tag{8}$$

where L(i) increases for high frequency components as a function of i, and M is the order of synthesis filter (LP). As an example, when applied to the AMR Wideband codec, L(i) vector can have the following values:

$$\frac{12800}{32768}\{128, 140, 152, 164, 176, 188, 200, 212, 224, 236, 248, 260, 272, 284, 296, 0\}$$

(see 3rd Generation Partnership Project, Technical Specification Group Services and System Aspects, Mandatory Speech Codec speech processing functions, AMR Wideband speech codec, Transcoding functions (3G TS 26.190 version 0.02)). It should be noted that here the ISF domain is used for spectral representation, and the second to last element of the vector (i−M−2) represents the highest frequency and the first element of the vector (i=0). IN the LSF domain, the last element of the vector (i−M−1) represents the highest frequency and the first element of the vector (i=0)

Dithering insertion for energy parameters is analogous to spectral dithering and can be computed according to Eq.4. In the logarithmic domain, dithering insertion for energy parameters is as follows:

$$en_{\log}^{mean} = en_{\log}^{mean} + rand(-L, L) \tag{9}$$

Figure 7:
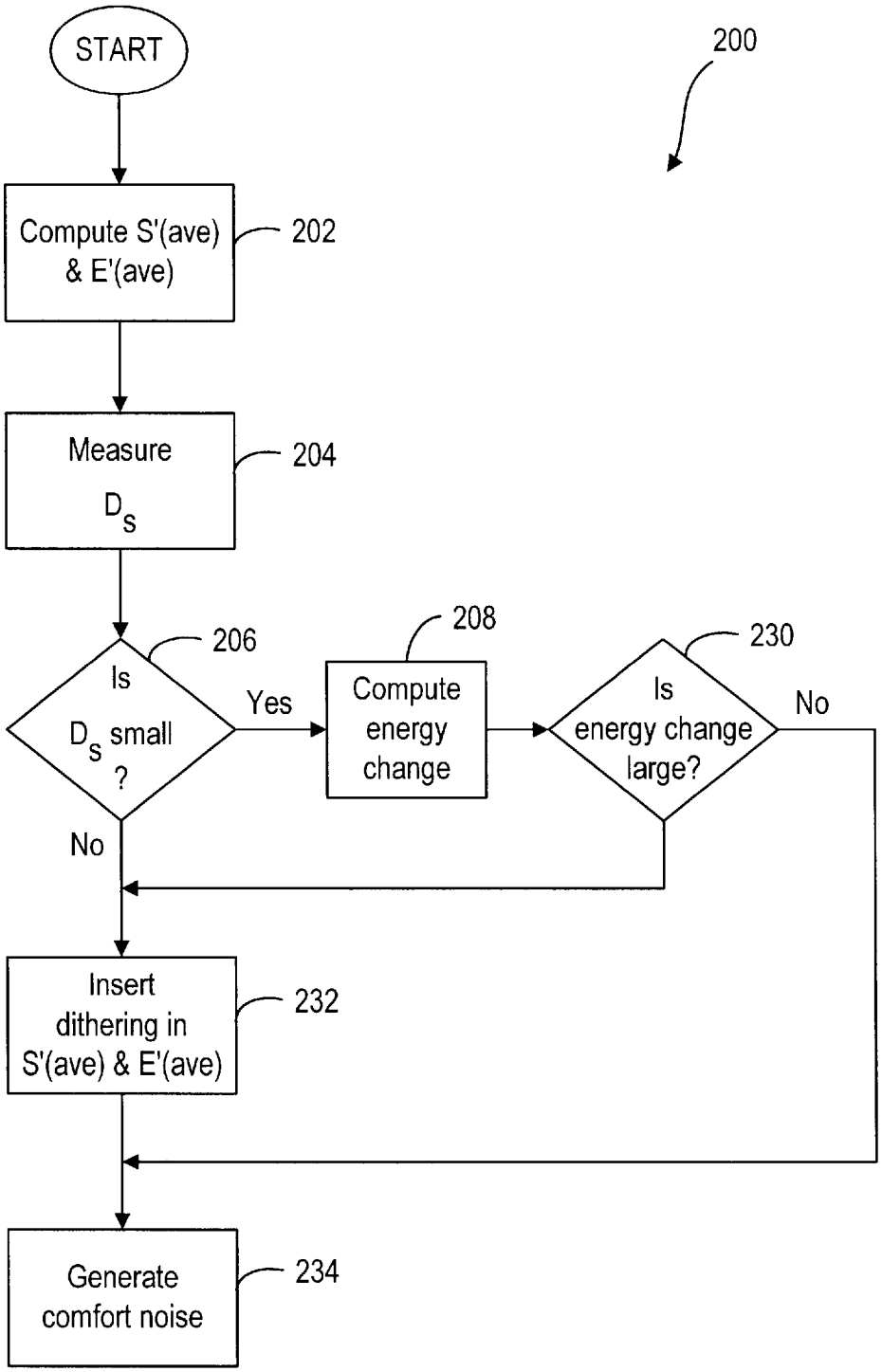
FIG. 7 is a flow chart illustrating the method of comfort noise generation, according to the present invention.

FIG. 7 is a flow-chart illustrating the method of generating comfort noise during the non-speech periods, according to the present invention. As shown in the flow-chart 200, the average spectral parameter vector $S'_{ave}$, and the average received energy $E'_{ave}$ are computed at step 202. At step 204, the total spectral distance $D_s$ is computed. At step 206, if is determined that $D_s$ is not smaller than a predetermined value, (e.g., 67108864 in fixed-point arithmetic), then the stationarity-flag is NOT set. Accordingly, dithering is inserted into $S'_{ave}$ and $E'_{ave}$ at step 232, resulting in $S''_{ave}$ and $E''_{ave}$. If $D_s$ is smaller than the predetermined value, then the stationarity-flag is set. The dithering process at step 232 is bypassed, or $S''_{ave}=S'_{ave}$ and $E''_{ave}=E'_{ave}$. Optionally, a step 208 is carried out to measure the energy change between frames. If the energy change is large, as determined at step 230, then the stationarity-flag is reset and the process is looped back to step 232. Based on $S''_{ave}$ and $E''_{ave}$, the comfort noise is generated at step 234.

Three different background noise types have been tested using the method, according to the invention. With car noise, 95.0% of the comfort noise frames are classified as stationary. With office noise, 36.9% of the comfort noise frames are classified as stationary and with street noise, 25.8% of the comfort noise frames are classified as stationary. This is a very good result, since car noise is mostly stationary background noise, whereas office and street noise are mostly non-stationary types of background noise.

It should be noted that the computation regarding stationarity-flag, according to the present invention, is carried out totally in the encoder. As such, the computation delay is substantially reduced, as compared to the decoder-only method, as disclosed in WO 00/31719. Furthermore, the method, according to the present invention, uses only one bit to send information from the encoder to the decoder for comfort noise modification. In contrast, a much higher bit-rate is required in the transmission channel if the computation is divided between the encoder and decoder, as disclosed in WO 00/31719.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A method of generating comfort noise in speech communication having speech periods and non-speech periods, wherein signals indicative of a speech input are provided in frames from a transmit side to a receive side for carrying out said speech communication, and the speech input has a speech component and a non-speech component, the non-speech component classifiable as stationary or non-stationary, said method comprising the steps of:

determining whether the non-speech component is stationary or non-stationary;

providing in the transmit side a further signal having a first value indicating that the non-speech component is stationary or a second value indicative of the non-speech component is non-stationary; and providing in the receive side the comfort noise in the non-speech periods, responsive to said further signal received from the transmit side, in a manner based on whether the further signal has the first value or the second value.

2. The method of claim 1, wherein the non-speech component is a background noise in the transmit side.

3. The method of claim 1, wherein the comfort noise is provided with a random component if the further signal has the second value.

4. The method of claim 1, wherein the signals include a spectral parameter vector and an energy level estimated from a spectrum of the non-speech component, and the comfort noise is generated based on the spectral parameter vector and the energy level.

5. The method of claim 4, wherein if the further signal has the second value, a random value is inserted into elements of the spectral parameter vector prior to the comfort noise being provided.

6. The method of claim 5, wherein the random value is bounded by −L and −L, wherein L is a predetermined value.

7. A method of generating comfort noise in speech communication having speech periods and non-speech periods, wherein signals indicative of a speech input are provided in frames from a transmit side to a receive side for carrying out said speech communication, and the speech input has a speech component and a non-speech component, the non-speech component classifiable as stationary or non-stationary, said method comprising the steps of:

determining whether the non-speech component is stationary or non-stationary;

providing in the transmit side a further signal having a first value indicating that the non-speech component is stationary or a second value indicating that the non-speech component is non-stationary; and providing in the receive side the comfort noise in the non-speech periods, responsive to said further signal received from the transmit side, in a manner based on whether the further signal has the first value or the second value, wherein the signals include a spectral parameter vector and an energy level estimated from a spectrum of the non-speech component, and the comfort noise is generated based on the spectral parameter vector and the energy level, and wherein if the further signal has the second value, a random value is inserted into elements of the spectral parameter vector prior to the comfort noise being provided, and the random value is bounded by −L and −L. wherein L is a predetermined value, and wherein the predetermined value is substantially equal to 100+0.8i Hz.

8. A method of generating comfort noise in speech communication having speech periods and non-speech periods, wherein signals indicative of a speech input are provided in frames from a transmit side to a receive side for carrying out said speech communication, and the speech input has a speech component and a non-speech component. the non-speech component classifiable as stationary or non-stationary, said method comprising the steps of:

determining whether the non-speech component is stationary or non-stationary;

providing in the transmit side a further signal having a first value indicating that the non-speech component is stationary or a second value indicating that the non-speech component is non-stationary; and providing in the receive side the comfort noise in the non-speech periods, responsive to said further signal received from the transmit side, in a manner based on whether the further signal has the first value or the second value, wherein the signals include a spectral parameter vector and an energy level estimated from a spectrum of the non-speech component, and the comfort noise is generated based on the spectral parameter vector and the energy level and if the further signal has the second value, a random value is inserted into elements of the spectral parameter vector prior to the comfort noise being provided, and wherein the random value is bounded by −L and L, wherein L is a value increasing with the elements representing higher frequencies.

9. The method of claim 4, wherein if the further signal has the second value, a first set of random values is inserted into elements of the spectral parameter vector, and a second random value is inserted into the energy level prior to the comfort noise being provided.

10. A method of generating comfort noise in speech communication having speech periods and non-speech periods, wherein signals indicative of a speech input are provided in frames from a transmit side to a receive side for carrying out said speech communication, and the speech input has a speech component and a non-speech component, the non-speech component classifiable as stationary or non-stationary, said method comprising the steps of:

determining whether the non-speech component is stationary or non-stationary;

providing in the transmit side a further signal having a first value indicating that the non-speech component is stationary or a second value indicating that the non-speech component is non-stationary; and providing in the receive side the comfort noise in the non-speech periods, responsive to said further signal received from the transmit side, in a manner based on whether the further signal has the first value or the second value, wherein the signals include a spectral parameter vector and an energy level estimated from a spectrum of the non-speech component, and the comfort noise is generated based on the spectral parameter vector and the energy level, and if the further signal has the second value, a first set of random values is inserted into elements of the spectral parameter vector, and a second random value is inserted into the energy level prior to the comfort noise being provided, and wherein the second random value is bounded by −75 and 75.

11. The method of claim 4, farther comprising the step of computing changes in the energy level between frames if the further signal has the first value, and wherein if the changes in the energy level exceed a predetermined value, the further signal is changed to have the second value and a random value vector is inserted into the spectral parameter vector prior to the comfort noise being provided.

12. The method of claim 4, further comprising the step of computing changes in the energy level between frames if the further signal has the first value, and wherein if the changes in the energy level exceed a predetermined value, the further signal is changed to have the second value and a random value vector is inserted into the spectral parameter vector and the energy level prior to the comfort noise being provided.

13. The method of claim 4, wherein the further signal includes a flag sent from the transmit side to the receive side for indicating whether the non-speech component is stationary or non-stationary, wherein the flag is set when the further signal has the first value and the flag is not set when the further signal has the second value.

14. The method of claim 13, wherein when the flag is not set, a random value is inserted into the spectral parameter vector prior to the comfort noise being provided.

15. The method of claim 13, further comprising the steps of:

computing changes in the energy level between frames if the further signal has the first value;

determining whether the changes in the energy level exceed a predetermined value; and resetting the flag if the changes exceed the predetermined value.

16. The method of claim 15, wherein when the flag is not set, a random value is inserted into the spectral parameter vector prior to the comfort noise being provided.

17. The method of claim 1, wherein the signals include a plurality of spectral parameter vectors representing the non-speech components, and the determining step is carried out based on spectral distances among the spectral parameter vectors.

18. The method of claim 17, wherein the spectral distances are summed over an averaging period for providing a summed value, and wherein the non-speech component is classified as stationary if the summed value is smaller than a predetermined value and the non-speech component is classified as non-stationary if the summed value is larger or equal to the predetermined value.

19. The method of claim 17, wherein the spectral parameter vectors are linear spectral frequency (LSF) vectors.

20. The method of claim 17, wherein the spectral parameter vectors are immittance spectral frequency (ISF) vectors.

21. The method of claim 1, wherein the further signal is a binary flag, the first value is 1 and the second value is 0.

22. The method of claim 1, wherein the further signal is a binary flag, the first value is 0 and the second value is 1.

23. A system for generating comfort noise in speech communication in a communication network having a transmit side for providing speech related parameters indicative of a speech input, and a receive side for reconstructing the speech input based on the speech related parameters, wherein the speech communication has speech periods and non-speech periods and the speech input has a speech component and a non-speech component, the non-speech component classifiable as stationary and non-stationary, and wherein the comfort noise is provided in the non-speech periods, said system comprising:

means, located on the transmit side, for determining whether the non-speech component is stationary or non-stationary for providing a signal having a first value indicative of the non-speech component being stationary or a second value indicative of the non-speech component being non-stationary; and means, located on the receive side, responsive to the signal, for inserting a random component in the comfort noise only if the signal has the second value.

24. A speech coder for use in speech communication having an encoder for providing speech parameters indicative of a speech input, and a decoder, responsive to the provided speech parameters, for reconstructing the speech input based on the speech parameters, wherein the speech communication has speech periods and non-speech periods and the speech input has a speech component and a non-speech component, the non-speech component classifiable as stationary or non-stationary, and wherein the encoder comprises a spectral analysis module, responsive to the speech input, for providing a spectral parameter vector and energy parameter indicative of the non-speech component of the speech input, and the decoder comprises means for providing a comfort noise in the non-speech periods to replace the non-speech component based on the spectral parameter vector and energy parameter, said speech coder comprising:

a noise detector module, located in the encoder, responsive to the spectral parameter vector and energy parameter, for determining whether the non-speech component is stationary or non-stationary and providing a signal having a first value indicative of the non-speech component being stationary and a second value indicative of the non-speech component being non-stationary; and a dithering module, located in the decoder, responsive to the signal, for inserting a random component in elements of the spectral parameter vector and energy parameter for modifying the comfort noise only if the non-speech component is non-stationary.

25. A method of providing comfort noise in speech communication having speech periods and non-speech periods, wherein signals indicative of a speech input are provided from a transmit side to a receive side for carrying out said speech communication, and wherein the speech input has a speech component and a non-speech component, the non-speech component classifiable as stationary or non-stationary, and the comfort noise is provided in the non-speech periods, said method comprising the steps of:

determining in the transmit side whether the non-speech component is stationary or non-stationary;

providing in transmit side a further signal indicative of said determining; and modifying the comfort noise in the receive side, responsive to the further signal received from the transmit side, if the non-speech component is non-stationary based on the further signal.

* * * * *

UNITED STATES PATENT AND TRADEMARK OFFICE

CERTIFICATE OF CORRECTION

PATENT NO. : 6,662,155 B2
DATED : December 9, 2003
INVENTOR(S) : Rotola-Pukkila et al.

It is certified that error appears in the above-identified patent and that said Letters Patent is hereby corrected as shown below:

Column 10,
Line 63, "-L." should be -- -L, --.

Signed and Sealed this

Twenty-second Day of June, 2004

JON W. DUDAS
*Acting Director of the United States Patent and Trademark Office*